US005845699A

United States Patent [19]

Baharis

[11] Patent Number: 5,845,699

[45] Date of Patent: Dec. 8, 1998

[54] STRIP CASTING

[75] Inventor: Chris Baharis, Watirna, Australia

[73] Assignees: Ishikawajima-Harima Heavy Industries Company Limited, Tokyo, Japan; BHP Steel (JLA) Pty Ltd, Melbourne, Australia

[21] Appl. No.: 855,617

[22] Filed: May 13, 1997

[30] Foreign Application Priority Data

May 13, 1996 [AU] Australia ..... PN 9802

[51] Int. Cl.[6] ..... B22D 11/06; B22D 27/02

[52] U.S. Cl. ..... 164/480; 164/428; 164/466; 164/498

[58] Field of Search ..... 164/428, 488, 164/466, 502, 493, 498, 507, 513

[56] References Cited

U.S. PATENT DOCUMENTS 5,259,439 11/1993 Blejde et al. ..... 164/480

FOREIGN PATENT DOCUMENTS 4-178248 6/1992 Japan ..... 164/428

*Primary Examiner*—Kuang Y. Lin

*Attorney, Agent, or Firm*—Nikaido, Marmelstein Murray & Oram LLP

[57] ABSTRACT

Twin roll casting of metal strip by introducing molten metal between chilled casting rolls (16) to form casting pool supported on the rolls and confined by refractory end closures (56), and rotating the rolls (16) so as to cast a solidified strip delivered downwardly from the nip between the rolls (16). Prior to casting refractory end closures (56) are preheated by positioning adjacent their inner faces a pair of metal plates (130) and exposing those plates to electromagnetic fields to cause them to rise in temperature and so heat the closures (56). Plates (130) have hooked top flanges (131) for location on the refractory end closures (56).

14 Claims, 6 Drawing Sheets

83
41
43
42
11
32
33
54
53
101
82
6
57
130
56
61
52
16
64
66
18
31
13

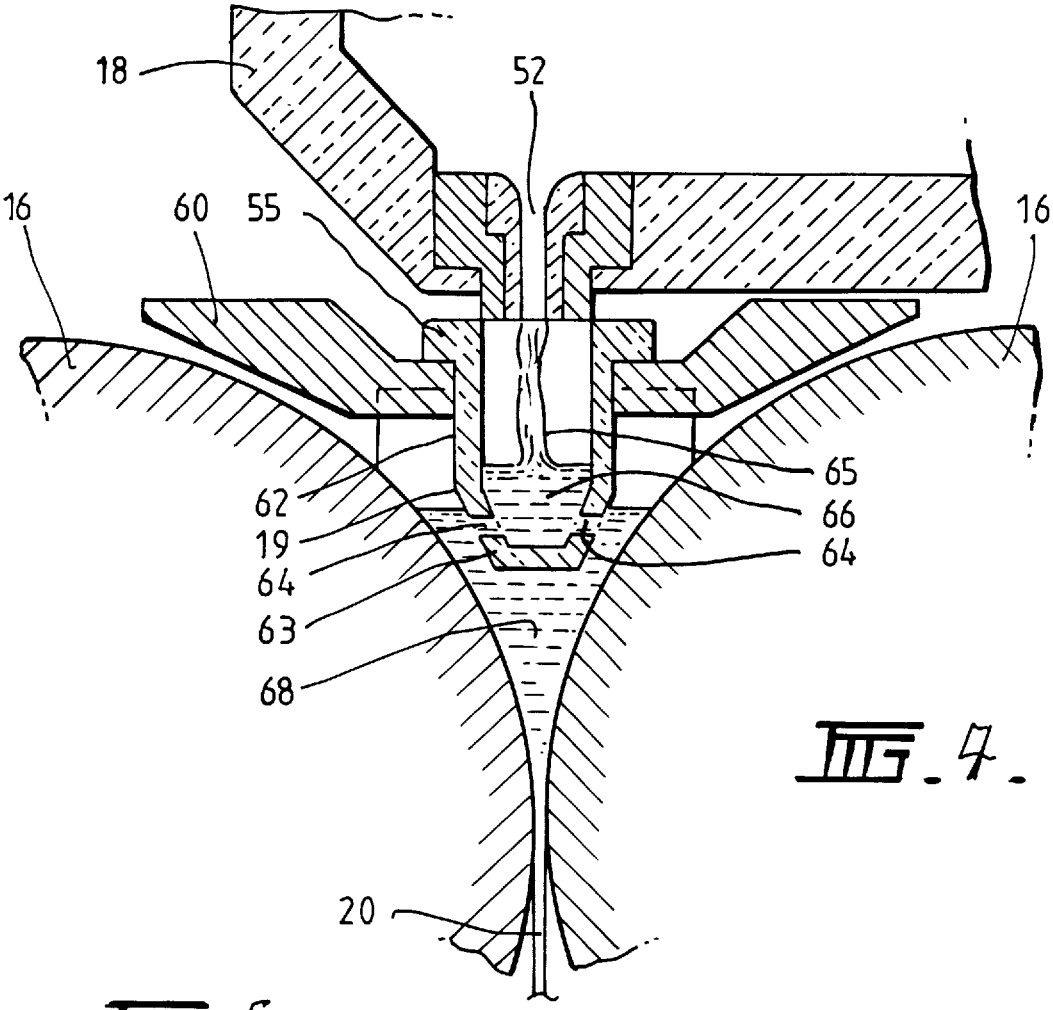
FIG. 4.
FIG. 5.
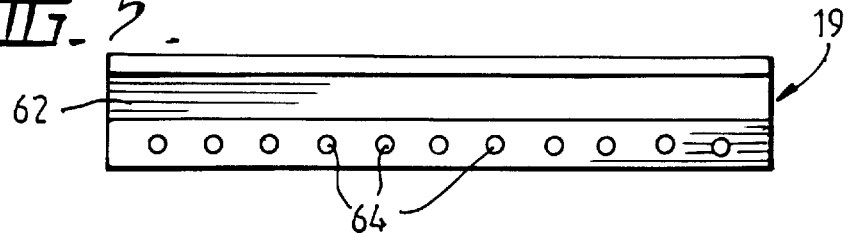
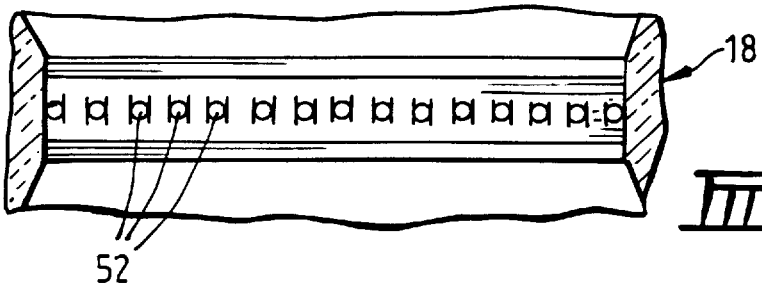
FIG. 6.

STRIP CASTING

BACKGROUND OF THE INVENTION

This invention relates to the casting of metal strip. It has particular but not exclusive application to the casting of ferrous metal strip.

It is known to cast metal strip by continuous casting in a twin roll caster. Molten metal is introduced between a pair of contra-rotated horizontal casting rolls which are cooled so that metal shells solidify on the moving roll surfaces and are brought together at the nip between them to produce a solidified strip product delivered downwardly from the nip between the rolls. The term "nip" is used herein to refer to the general region at which the rolls are closest together. The molten metal may be poured from a ladle into a smaller vessel from which it flows through a metal delivery nozzle located above the nip so as to direct it into the nip between the rolls, so forming a casting pool of molten metal supported on the casting surfaces of the rolls immediately above the nip. This casting pool may be confined between side plates or dams held in sliding engagement with the ends of the rolls.

Prior to commencement of casting it is necessary to preheat the refractory materials in the metal delivery system and the pool end closure plates or dams to a high temperature to prevent premature solidification of the molten metal during start up. Particularly when casting ferrous metals, the refractories must be preheated to very high temperatures in excess of 1000° C. This has generally been achieved by heating the individual refractory components in inert atmospheres in preheat furnaces which are gas or electrically heated. Preheating in this manner generally takes at least 45 minutes and the preheated end closures must then be moved into assembly with the casting rolls immediately prior to commencement of a cast. This requires rapid assembly of extremely hot components within a very short time interval to prevent temperature run down before commencement of casting, generally necessitating complex robotics and an elaborate start up regime. The present invention enables some simplification of the start up procedure by enabling the pool end closures to be preheated rapidly in any convenient location and even in situ.

SUMMARY OF THE INVENTION

According to the invention there is provided a method of casting metal strip comprising introducing molten metal between a pair of chilled casting rolls to form a casting pool of molten metal supported above the nip and confined at the ends of the nip by pool confining refractory end closures, and rotating the rolls so as to cast a solidified strip delivered downwardly from the nip; wherein prior to casting the pool end closures are preheated by positioning adjacent the end closures elements susceptible to exposure to an electromagnetic field in such manner as to cause them to rise in temperature and exposing each of said elements to an electromagnetic field whereby to cause them to rise in temperature and so heat the pool end closures.

The said elements may comprise metal plates in which electrical currents can be induced by exposure to an electromagnetic field whereby to cause them to rise in temperature. The plates may for example be steel plates.

Preferably said elements are positioned adjacent the inner faces of the pool end closures. Preferably further they are subjected to electromagnetic fields generated by passing electric current through a pair of electrical conductors disposed adjacent the outer faces of the respective end closures.

Said elements may be removed before casting is commenced. Alternatively they may be left in position adjacent the end closures and be totally or partially consumed by said molten metal on commencement of casting.

Electric current may continue to be passed through said electrical conductors during casting in order to heat molten metal in the casting pool by electromagnetic induction heating. In this case it is preferred that each electrical conductor is in the form of a conductor loop comprising a relatively wide top segment disposed generally at the level of the casting pool surface and a relatively narrow bottom segment connected by a pair of downwardly convergent side segments. The side segments may be curved to follow the conjunctions between the respective end closures and the casting rolls.

The invention also provides apparatus for casting metal strip, comprising a pair of parallel casting rolls forming a nip between them, metal delivery means to deliver molten metal into the nip to form a casting pool of molten metal supported above the nip and a pair of pool confining refractory end closures disposed one at each end of the pair of casting rolls, wherein there is a pair of electrical conductors disposed outside the end closures and electrical supply means to supply electrical current to the electrical conductors to generate electromagnetic fields in the vicinity of the end closures and a pair of elements disposed adjacent the end closures and susceptible to exposure to said electromagnetic fields in such manner as to rise in temperature and thereby heat the end closures.

BRIEF DESCRIPTION OF THE DRAWINGS

In order that the invention may be more fully explained one particular method and apparatus will be described in detail with reference to the accompanying drawings in which:

FIG. 4 is an enlarged transverse cross-section through the metal delivery nozzle and adjacent parts of the casting rolls;

FIG. 5 is a side elevation of the metal delivery nozzle;

FIG. 6 is a partial plan view on the line 6—6 in FIG. 3;

DETAILED DESCRIPTION OF THE PREFERRED EMBODIMENT

Figure 1:
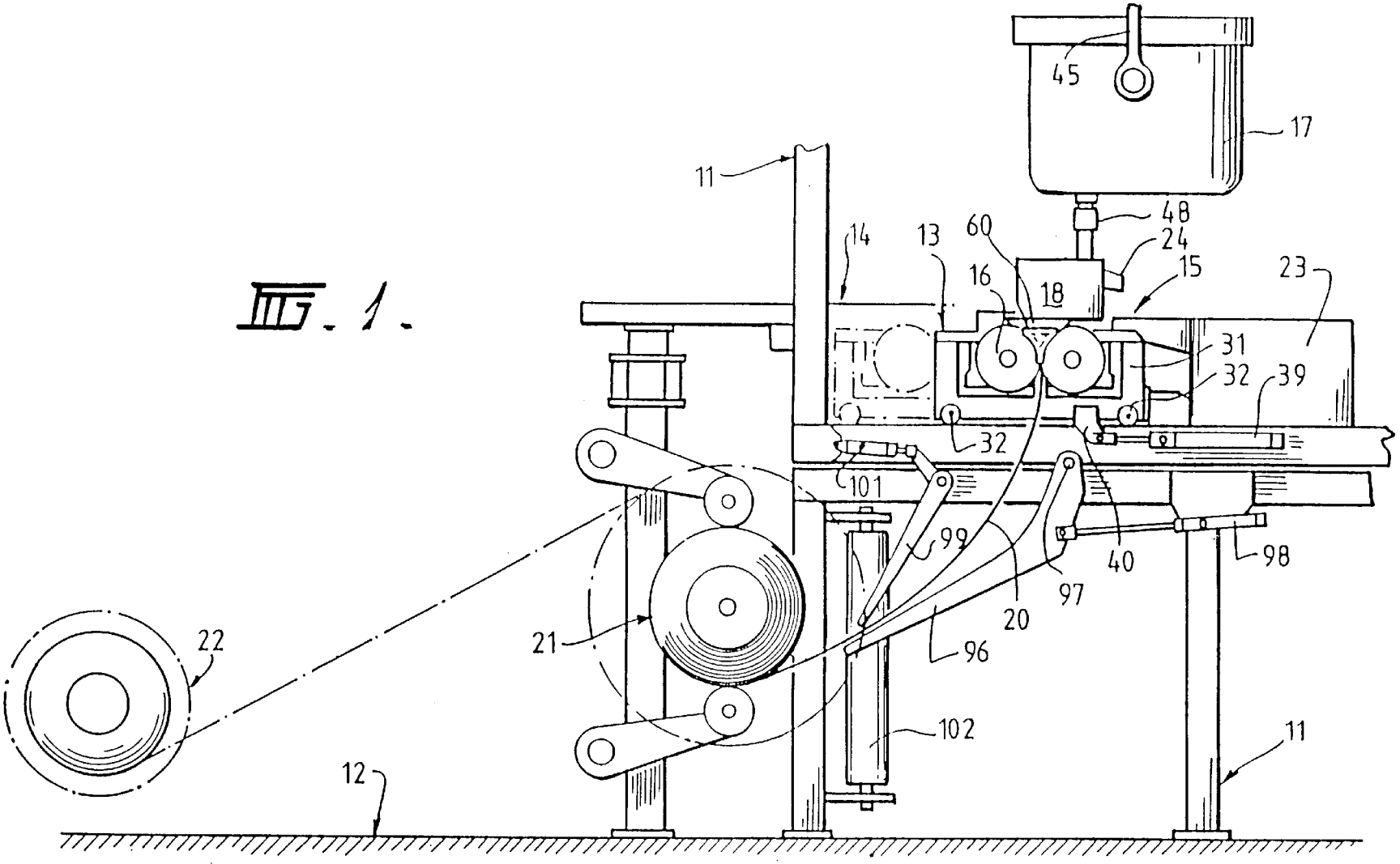
FIG. 1 illustrates a twin-roll continuous strip caster constructed and operating in accordance with the present invention.
Figure 2:
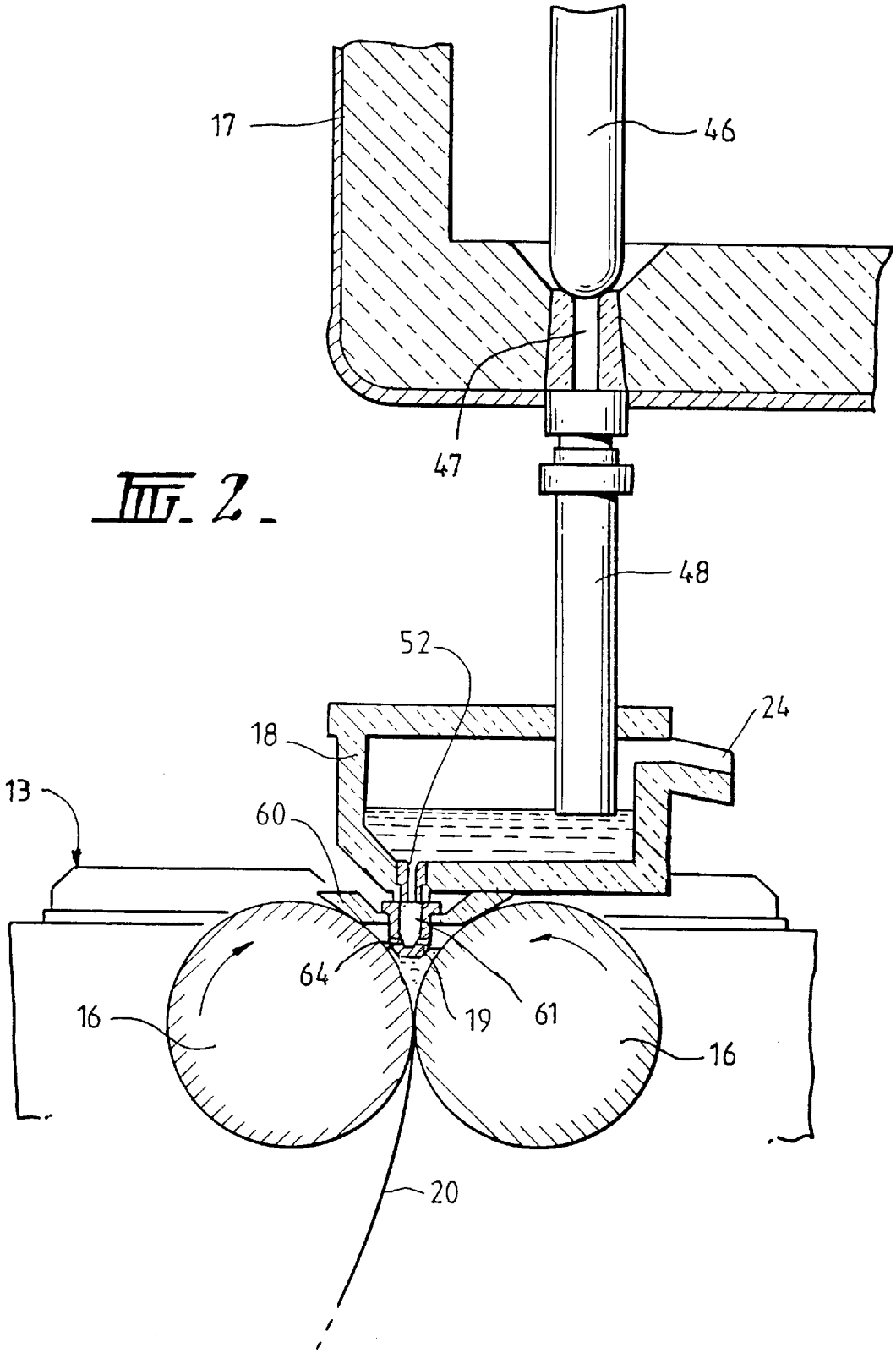
FIG. 2 is a vertical cross-section through important components of the caster illustrated in FIG. 1.
Figure 3:
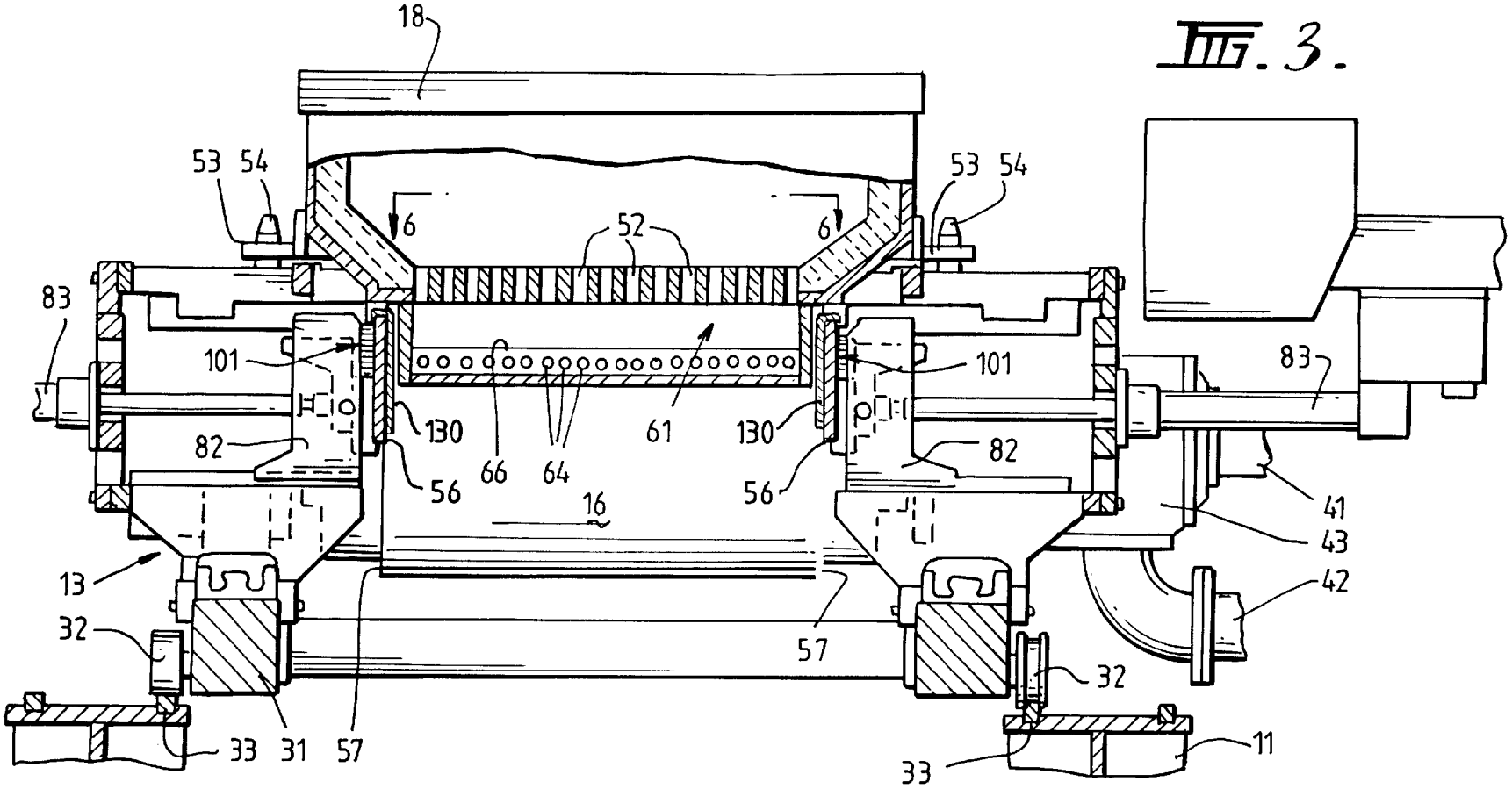
FIG. 3 is a further vertical cross-section through important components of the caster taken transverse to the section of FIG. 2.
Figure 7:
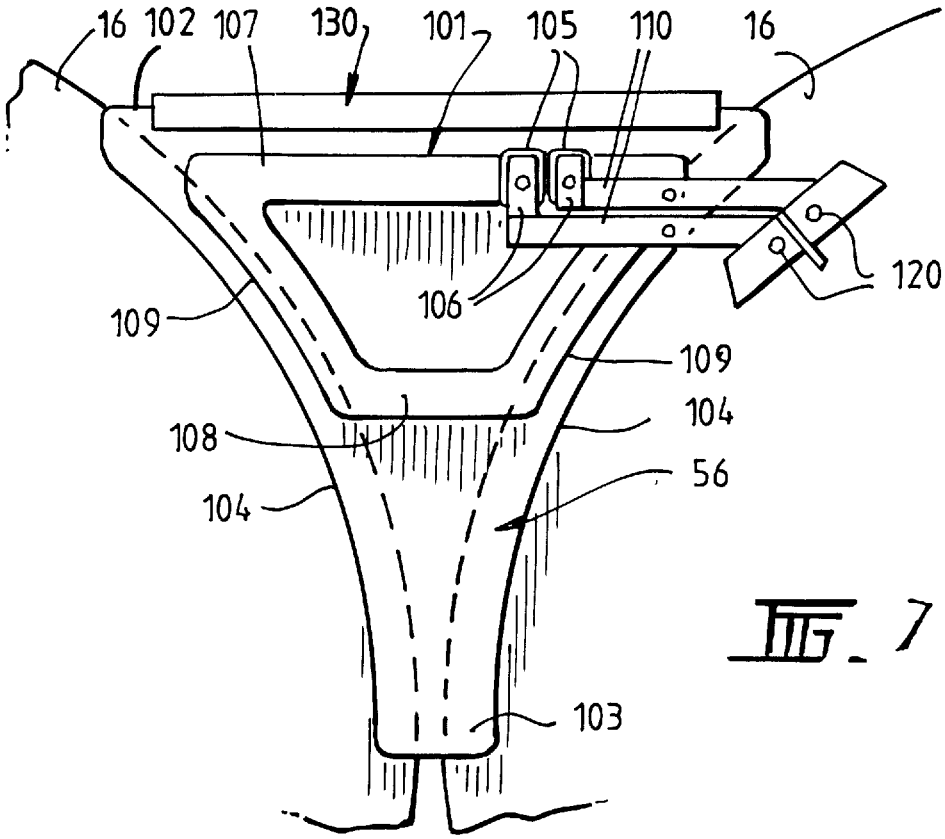
FIG. 7 is an end view of the casting rolls together with pool confinement and induction heating components of the caster.

The illustrated apparatus embodies both the present invention and the invention which is fully described in our co-pending Australian Patent Application No. PN9536 entitled STRIP CASTING filed on Apr. 18, 1996. The latter invention is concerned with electromagnetic heating of the molten metal in the casting pool in the immediate vicinity of the casting pool surface so as to prevent the formation of pieces of solid metal known as "skulls" in the vicinity of the pool confining end closures. The formation of such skulls is particularly a problem in casting of steel strip. The skulls of solid metal can grow to a considerable size and fall between the rolls causing the rolls to "spring" apart and so generate severe defects in the strip. The illustrated caster is fitted with a pair of induction heater elements immediately outside the pool end closures which can be operated during casting to heat molten metal in the casting pool in the immediate vicinity of the casting pool surface in order to prevent the formation of "skulls". In accordance with the present invention, these induction heaters may be operated prior to commencement of casting in conjunction with "susceptor" elements placed adjacent the pool end closures in order to preheat the pool end closure members in situ.

The illustrated caster comprises a main machine frame 11 which stands up from the factory floor 12. Frame 11 supports a casting roll carriage 13 which is horizontally movable between an assembly station 14 and a casting station 15. Carriage 13 carries a pair of parallel casting rolls 16 to which molten metal is supplied during a casting operation from a ladle 17 via a distributor 18 and delivery nozzle 19. Casting rolls 16 are water cooled so that shells solidify on the moving roll surfaces and are brought together at the nip between them to produce a solidified strip product 20 at the nip outlet. This product is fed to a standard coiler 21 and may subsequently be transferred to a second coiler 22. A receptacle 23 is mounted on the machine frame adjacent the casting station and molten metal can be diverted into this receptacle via an overflow spout 24 on the distributor.

Roll carriage 13 comprises a carriage frame 31 mounted by wheels 32 on rails 33 extending along part of the main machine frame 11 whereby roll carriage 13 as a whole is mounted for movement along the rails 33. Carriage frame 31 carries a pair of roll cradles 34 in which the rolls 16 are rotatably mounted. Carriage 13 is movable along the rails 33 by actuation of a double acting hydraulic piston and cylinder unit 39, connected between a drive bracket 40 on the roll carriage and the main machine frame so as to be actuable to move the roll carriage between the assembly station 14 and casting station 15 and visa versa.

Casting rolls 16 are contra rotated through drive shafts 41 from an electric motor and transmission mounted on carriage frame 31. Rolls 16 have copper peripheral walls formed with a series of longitudinally extending and circumferentially spaced water cooling passages supplied with cooling water through the roll ends from water supply ducts in the roll drive shafts 41 which are connected to water supply hoses 42 through rotary glands 43. The rolls may typically be about 500 mm diameter and up to 2 m long in order to produce up to 2 m wide strip product.

Ladle 17 is of entirely conventional construction and is supported via a yoke 45 on an overhead crane whence it can be brought into position from a hot metal receiving station. The ladle is fitted with a stopper rod 46 actuable by a servo cylinder to allow molten metal to flow from the ladle through an outlet nozzle 47 and refractory shroud 48 into distributor 18.

Distributor 18 is formed as a wide dish made of a refractory material such as high alumina castable with a sacrificial lining. One side of the distributor receives molten metal from the ladle and is provided with the aforesaid overflow 24. The other side of the distributor is provided with a series of longitudinally spaced metal outlet openings 52. The lower part of the distributor carries mounting brackets 53 for mounting the distributor onto the roll carriage frame 31 and provided with apertures to receive indexing pegs 54 on the carriage frame so as accurately to locate the distributor.

Delivery nozzle 19 is formed as an elongate body made of a refractory material such as alumina graphite. Its lower part is tapered so as to converge inwardly and downwardly so that it can project into the nip between casting rolls 16. A mounting bracket 60 is provided to support the nozzle on the roll carriage frame and the upper part of the nozzle is formed with outwardly projecting side flanges 55 which locate on the mounting bracket.

Delivery nozzle 19 has an upwardly opening inlet trough 61 to receive molten metal flowing downwardly through the openings 52 of the distributor. The bottom part of trough 61 is formed between downwardly convergent nozzle side walls 62 and the bottom is closed by a horizontal bottom floor 63. Each longitudinal side wall 62 is perforated by a series of horizontally spaced openings 64 in the form of circular holes extending horizontally through the side walls.

Molten metal falls from the outlet openings 52 of the distributor in a series of free-falling vertical streams 65 to form a reservoir 66 of molten metal in the bottom part of the nozzle trough 61. Molten metal flows from this reservoir out through the openings 64 to form a casting pool 65 supported above the nip 66 between the casting rolls 16. The casting pool is confined at the ends of rolls 16 by a pair of refractory end closures in the form of plates 56 which are held against the ends 57 of the rolls. End closure plates 56 are made of strong refractory material, for example boron nitride. They are mounted in plate holders 82 which are movable by actuation of a pair of hydraulic cylinder units 83 to bring the plates 56 into engagement with the ends of the casting rolls to form end closures for the casting pool of molten metal.

In the casting operation the flow of metal is controlled to maintain the casting pool at a level such that the lower end of the delivery nozzle 19 is submerged in the casting pool and the two series of horizontally spaced openings 64 of the delivery nozzle are disposed immediately beneath the surface of the casting pool. The molten metal then flows from the reservoir within the nozzle trough 61 through the openings 64 in two laterally outwardly directed jet streams in the general vicinity of the casting pool surface so as to impinge on the cooling surfaces of the rolls in the immediate vicinity of the pool surface. This maximises the temperature of the molten metal delivered to the meniscus regions of the pool and it has been found that this significantly reduces the formation of cracks and meniscus marks on the melting strip surface.

In accordance with the invention disclosed in Australian Patent Application PN9356, a pair of induction heater elements 101 are disposed immediately outside the side plates 56. More specifically the heater elements are mounted on the thruster bodies 85 so as to back upper parts of the side plates 56 without interfering with pivoting movement of the side plates about the pivot pins 84.

Figure 8:
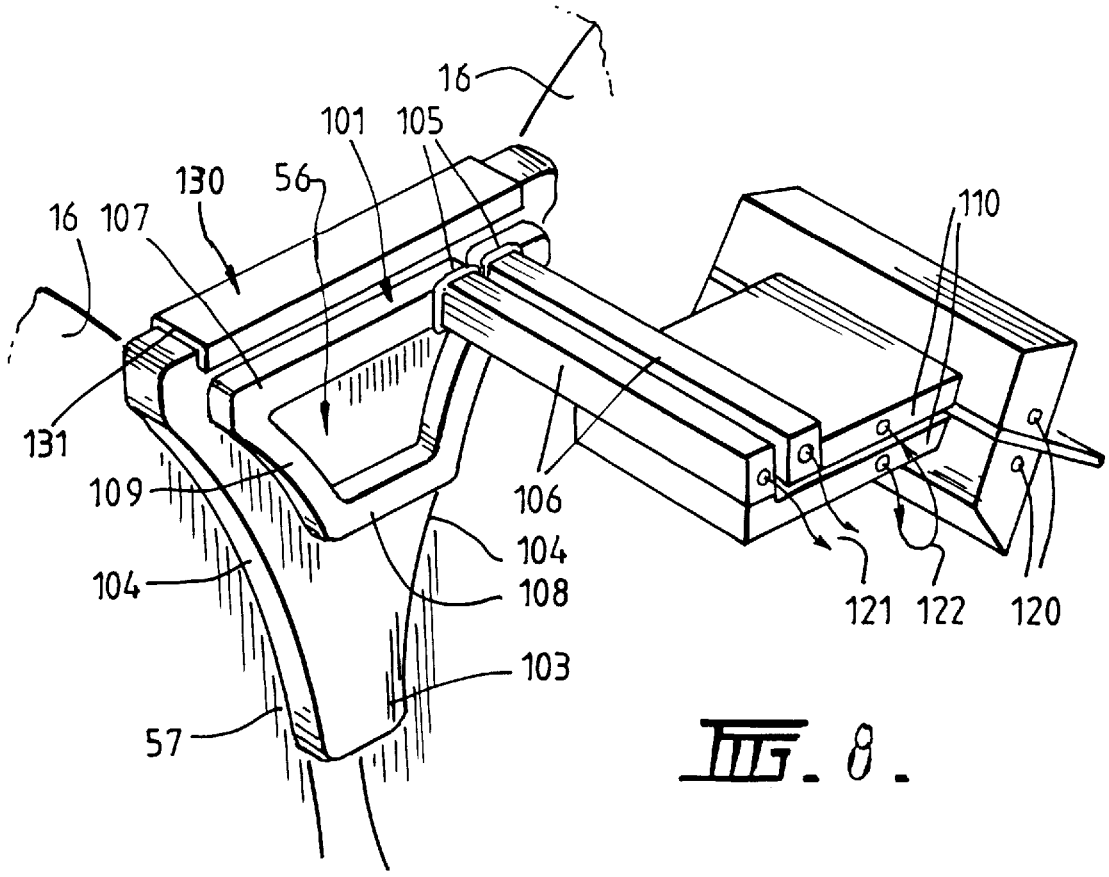
FIG. 8 is a diagrammatic perspective view of the components shown in FIG. 7.
Figure 9:
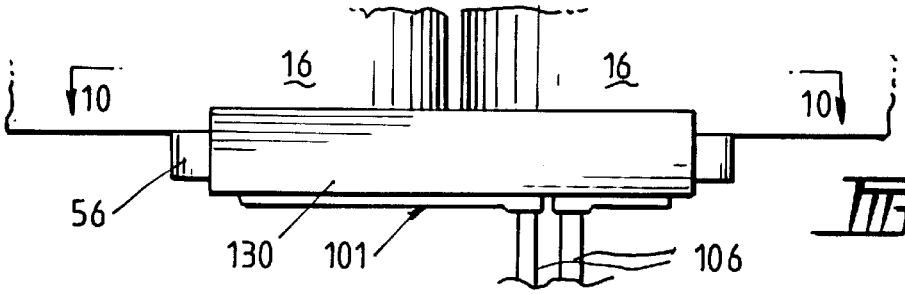
FIG. 9 is a plan view of an end part of the caster.

Each end closure plate 56 is shaped so as to have a wide top 102 and a narrow bottom 103 connected by arcuate sides 104 which overlap the ends 57 of the casting rolls 16. Each of the induction heater elements 101 comprises a generally trapezium shaped electrical conductor structure disposed adjacent the back of the respective closure plate 56 so as in use of the apparatus to be adjacent the upper part of the casting pool. More particularly, it is shaped as a thick walled tubular copper conductor of generally rectangular cross-section extending in a trapezium shaped loop from parallel terminal sockets 105 through which it is supplied with alternating electric current through parallel tubular conductors 106 connected by bus bars 110 to alternating current supply leads 120. Cooling water is circulated through the loops via the conductors 106 as indicated by arrows 121 in FIG. 8 and a separate flow of cooling water is passed through the bus bars 110 as indicated by arrows 122.

Each trapezium shaped copper loop has a wide top segment 107 arranged generally at the height of the casting pool surface and a narrower bottom segment 108 arranged to be disposed about 70 mm below the pool surface. The top and bottom segments are connected by arcuate side segments 109 which follow the curvature of the casting rolls 11.

The electric induction heater elements 101 are effective to cause inductive heating of molten metal in the upper part of the casting pool immediately adjacent the side dam plates 56. The coils are designed to maximise heating around the triple points at the meniscus regions of the pool. It has been demonstrated that this is effective to inhibit the formation of "skulls" at this region of the pool and that in combination with a nozzle which delivers a uniform flow of metal throughout the length of the rolls to the meniscus regions of the pool it is possible to dramatically reduce the superheat of the molten metal supplied for casting and that superheats of lower than 70° C. can be achieved.

It has been found that with electrically non-conducting side plates the electromagnetic fields produced by the shaped induction heater elements can extend through the side plates to cause effective heating of the molten metal in the pool without heating the side plates and without the need for field shaping or concentrating elements. However, it would be within the scope of the invention to provide appropriate field shaping core pieces around the conductor loops to serve as field concentrator's in order to reduce the electrical power requirements.

In accordance with the present invention, the induction heaters 101 may be used to preheat the end closure plates 56 in situ prior to casting instead of preheating them in separate furnaces and then bringing them into assembly in the caster. This is achieved by providing the plates 56 with magnetic "susceptors" which are highly sensitive to the electromagnetic field generated by the conductors and heat up so as to preheat the side dam plates by direct conduction. The susceptors are in the form of metal plates 130 placed against the faces of the side plates 56 opposite to the heater conductors 101 and provided at their upper margins with flanges 131 which hook over the tops 102 of the end closure plates 56 to support the susceptor plates in position. Each susceptor plate has arcuate edges 132 which follow the curvature of the casting rolls to the bottom 133 of the susceptor plate. The susceptors are shaped and supported so that they are held clear of the casting surfaces of the rolls but cover a very substantial part of the respective end closure plate 56 down to the nip region between the rolls.

The electromagnetic fields generated by heaters 101 induce eddy currents in the susceptors which causes them to be heated to high temperatures and it is quite possible by this means to preheat the side dam plates to temperatures in excess of 1000° C. The susceptor plates 120 can be removed from the apparatus after preheating of the end closure. Alternatively they may simply be left in place so as to be totally or partially dissolved by the molten metal of the casting pool during casting start-up. The susceptor plates 120 may for example be steel having a melting point lower than that of the molten steel to be cast.

The susceptor plates 130 may be located on the end closure plates 56 before or after the closure plates are brought into position against the ends of the casting rolls.

The induction heater elements 101 should not extend down to the lower parts of the casting pool. It has been found that the very damaging "skulls" are only formed in the upper part of the pool to a depth of about 70 mm. In the lower regions of the pool as the rolls approach the nip metal has already solidified and it is important that it not be reheated at this stage. This can be ensured if the heating coils are spaced above the nip such that they do not extend downwardly to the level of the bottom third of the depth of the casting pool. Previous proposals for induction heating of the pool have simply been directed to heating the pool in general and have involved heaters effective throughout the depth of the pool. Further, the location of the heater elements 101 well above the nip between the casting rolls allows the piston rods 84 of the cylinder units 83 and the associated thruster components to sit below the heater elements and this allows the side plates 56 to tilt about pins 84 as previously described without interference or inadvertent heating of the thruster components.

Figure 10:
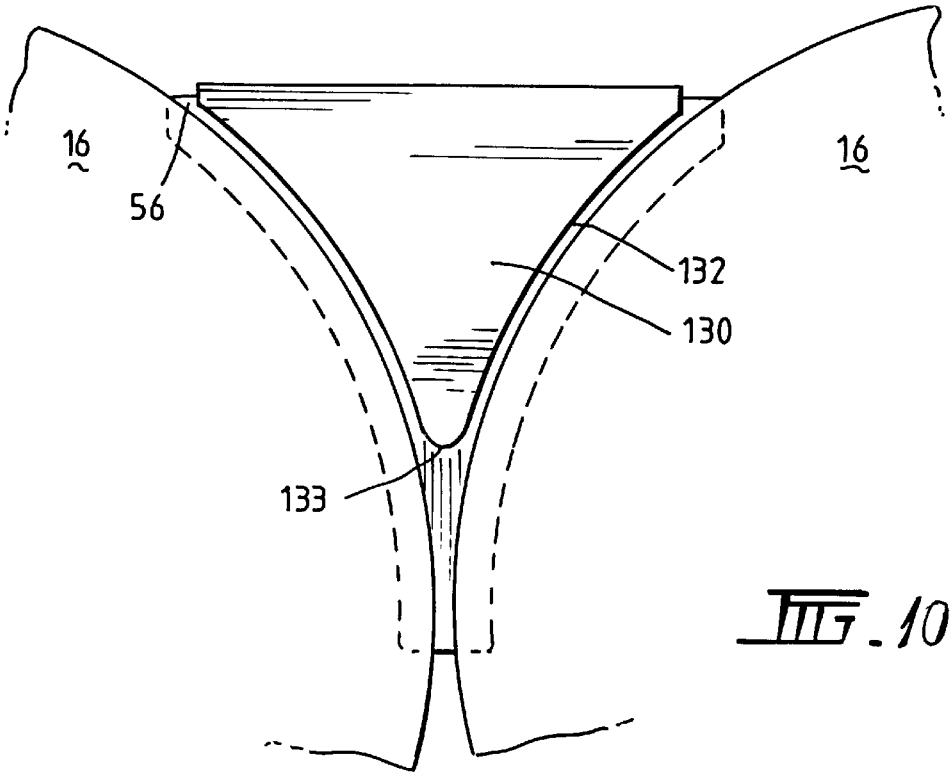
FIG. 10 is a view on the line 10—10 in FIG. 9.

The plates 130 may be cut to a trapezium formation slightly larger than the induction heaters 101 but preferably they are extended down to the region as seen in FIG. 10.

Figure 11:
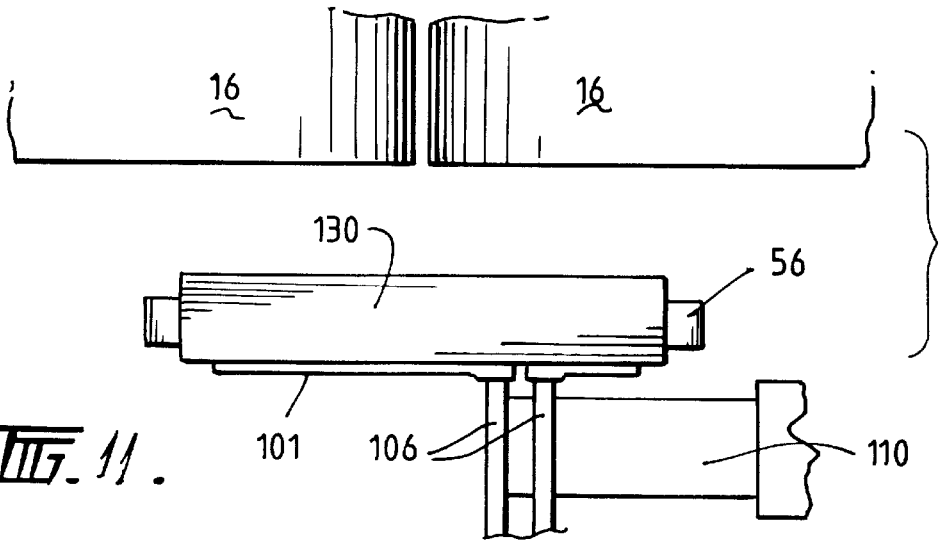
FIG. 11 illustrates an alternative condition of the apparatus for preheating end closures to the caster.

FIG. 11 illustrates an end of the caster with the respective end closure plate 56 withdrawn from engagement with the ends of the rolls but with the associated susceptor 130 already fitted to it. It will be appreciated that instead of moving the plate into its operative or casting position prior to preheating, the induction heater may be operated to preheat the plate before it is moved to its final position. In that case the susceptor can be removed before the closure plate is brought into engagement with the ends of the rolls. Accordingly, the susceptor plate can cover the whole face of the end closure plate and in fact its shape and size will not be critical.

In operation of a typical twin roll caster producing one meter wide steel strip at the rate of 60 m/min the induction heaters will need to be supplied with electric current in the range 3000–8000 amps at a frequency of 6 kHz to 10 kHz. The total power input to the induction heaters will accordingly be of the order of 10–100 kWatts per heater. It has been determined that this will be quite sufficient to preheat the refractory end closures to temperatures of the order of 1400° C. in less than 15 minutes.

The illustrated apparatus has been advanced by way of example only and it could be modified considerably. For example, instead of delivering molten metal from the tundish into the delivery nozzle in a series of free-falling streams as in the apparatus illustrated in FIGS. 1 to 6, the metal may be delivered in the delivery nozzle through a submerged entry nozzle. This may be in the form of a single tube as disclosed in the applicants' International Application PCT/AU97/00022. This would allow sufficiently direct flow of the molten metal through the delivery nozzle outlets distributed uniformly along the casting pool to deliver molten metal rapidly to the meniscus regions of the pool.

I claim:

1. A method of casting metal strip by introducing molten metal between a pair of chilled casting rolls to form a casting pool of molten metal supported above the nip, confining the pool at the ends of the nip by pool confining refractory end closures, and rotating the rolls so as to cast a solidified strip delivered downwardly from the nip; comprising preheating the pool end closures prior to casting by positioning adjacent the end closures elements susceptible to exposure to an electromagnetic field in such manner as to cause them to rise in temperature and exposing each of said elements to an electromagnetic field whereby to cause them to rise in temperature and so heat the pool end closures.

2. A method as claimed in claim 1, wherein said elements are in the form of metal plates in which electrical currents can be induced by exposure to an electromagnetic field whereby to cause them to rise in temperature.

3. A method as claimed in claim 2, wherein the plates are steel plates.

4. A method as claimed in claim 1, wherein said elements are positioned adjacent the inner faces of the pool end closures.

5. A method as claimed in claim 4, wherein said elements are subjected to electromagnetic fields generated by passing electric current through a pair of electrical conductors disposed adjacent the outer faces of the respective end closures.

6. A method as claimed in claim 5, wherein said elements are subjected to said electromagnetic fields to heat the end closures with the end closures disposed in their operative positions against the ends of the casting rolls.

7. A method as claimed in claim 6, wherein said elements are supported on the end closures without contacting the casting rolls.

8. A method as claimed in claim 1, wherein said elements are removed before casting is commenced.

9. A method as claimed in claim 1, wherein said elements are left in position adjacent the end closures and are consumed by said molten metal on commencement of casting.

10. A method as claimed in claim 9, wherein said elements are made of metal having a melting point lower than that of the said molten metal.

11. A method as claimed in claim 1, wherein said elements are subjected to said electromagnetic fields to heat the end closures with the end closures in inoperative positions spaced from the roll ends, said elements are then withdrawn and the preheated end closures moved into engagement with the ends of the rolls.

12. A method as claimed in claim 1, wherein electric current continues to be passed through said electrical conductors during casting in order to heat molten metal in the casting pool by electromagnetic induction heating.

13. A method as claimed in claim 12, wherein each electrical conductor is in the form of a conductor loop comprising a relatively wide top segment disposed generally at the level of the casting pool surface and a relatively narrow bottom segment connected by a pair of downwardly convergent side segments.

14. A method as claimed in claim 13, wherein the side segments are curved to follow the conjunctions between the respective end closures and the casting rolls.

* * * * *